United States Patent [19]

Seefluth

[11] 4,455,782

[45] Jun. 26, 1984

[54] CARTESIAN TOY WITH ROTARY MOVEMENT IMPARTING CONTACT STRUCTURE

[76] Inventor: Uwe C. Seefluth, Alsterufer 37, 2000 Hamburg 36, Fed. Rep. of Germany

[21] Appl. No.: 271,211

[22] Filed: Jun. 8, 1981

[51] Int. Cl.[3] ..... A63H 23/06; A63H 23/08

[52] U.S. Cl. ..... 446/155; 272/8 N; 446/156

[58] Field of Search ..... 272/8 R, 8 N, 1 R, 27 R, 272/27 A, 8 D; 273/348, 350, 349, 1 GB, 1 L, 1 M, 1 GD; 46/91–96, 193; 40/406, 407, 409, 427

[56] References Cited

U.S. PATENT DOCUMENTS

| | | | |
|---|---|---|---|
| 1,991,626 | 2/1935 | Rawdon | 273/1 L |
| 2,345,243 | 3/1944 | Eakin | 46/92 |
| 2,509,112 | 5/1950 | Seaman | 272/8 N |
| 2,752,725 | 7/1956 | Unsworth | 273/1 L |
| 2,964,874 | 12/1960 | Ruiz | 46/94 |
| 3,077,697 | 2/1973 | Fry | 46/92 |
| 3,116,929 | 1/1964 | Kernodle | 273/1 GB |
| 3,695,607 | 10/1972 | Stouffer | 46/94 X |
| 3,924,350 | 12/1975 | Hsu | 273/1 L X |
| 4,065,874 | 1/1978 | Ross | 46/94 |

*Primary Examiner*—Richard T. Stouffer

[57] ABSTRACT

A cartesian toy including at least one partly transparent liquid container in which there is at least one freely floating body movable by buoyancy changes. This is variable in that an air bladder located in a cavity of the floating body casing is compressible to a greater or lesser extent by the liquid pressure in the liquid container being varied by a pressurizing device. When this device causes expansion of the air bladder or the air zone located in the floating body, liquid flowing out of the floating body casing additionally imparts to the floating body or parts thereof by recoil or reaction force an in particular horizontally directed acceleration or movement. Also, particularly sized and arranged casing parts on the floating body cause this body to move in one rotary direction or the other when the casing parts contact the container or objects in the container.

4 Claims, 10 Drawing Figures

CARTESIAN TOY WITH ROTARY MOVEMENT IMPARTING CONTACT STRUCTURE

BACKGROUND OF THE INVENTION

The present invention relates to a toy comprising at least one partly transparent liquid container in which there is at least one freely floating body movable by buoyancy changes, whose bouyancy is variable in that an air bladder located in a cavity of the floating body casing is compressible to a greater or lesser extent by the liquid pressure in the liquid container being variable by means of a pressurizing device.

In the case of such toys, the effect of apparent weightlessness of a body floating or suspended in water is utilized and the play and entertainment value results from the fact that it is possible to control in a random manner the rise and fall of the body or figure floating in the water.

It is known to attain the aforementioned entertainment effect by providing a water-filled bottle having a floating body with a bladder located in its casing, with an elastic rubber seal or closure in order to modify the bladder volume by exerting a greater or lesser pressure on the seal or closure. The floating body is then controlled in such a way that it moves up and down within the bottle.

A toy of this type is known in the form of a do-it-yourself toy, which can be assembled at home.

However, the entertainment effect of such a floating body which can move up and down in the water is very limited, because it is only possible to exert a limited control on the movement of the floating body with respect to the rising, falling and floating in the water.

BRIEF SUMMARY OF THE INVENTION

The problem of the present invention is to so extend and improve the aforementioned toy that, in addition to vertical movements, the floating body can simultaneously perform horizontal movements, while also being controllable and/or guidable.

According to the invention, this problem is solved in that on expanding the air bladder, liquid flowing out of the floating body casing by a reaction or recoil force imparts to the floating body or parts thereof a more particularly horizontally directed acceleration or movement. The cavity in the floating body casing filled with the liquid and the air bladder is constructed as a closed cavity connected to the surrounding container liquid only by at least one nozzle opening which, as the air bladder expands, and consequently with liquid flowing out of the casing, produces a directed liquid jet for accelerating the floating body.

In order to make a game of skill or entertainment from such a toy with a floating body horizontally and vertically movable in the liquid, the floating body and liquid container are, according to the invention, provided with a number of devices and additions, which will be described in greater detail in the remaining description.

BRIEF DESCRIPTION OF THE DRAWINGS

The invention is described in greater detail hereinafter relative to non-limitative embodiments and the attached drawings, wherein.

DETAILED DESCRIPTION OF THE PREFERRED EMBODIMENTS

Figure 1:
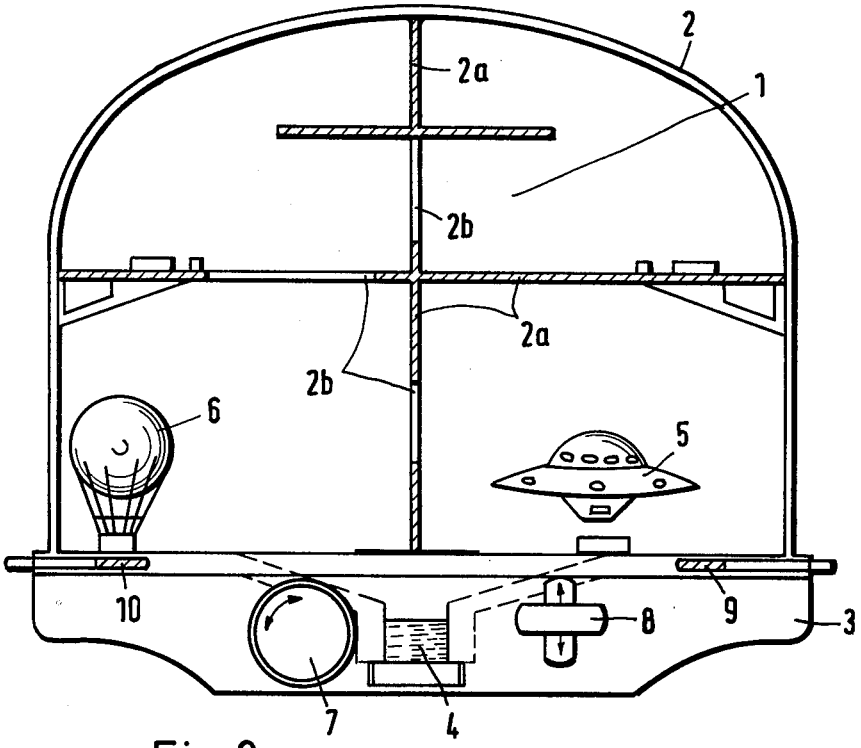
FIG. 1 is a side view of the liquid container with two floating bodies as an overall construction and partly in section.

In FIG. 1, the liquid container 1 comprises a transparent casing wall 2 and case 3. The container liquid filling connection 4 is in this embodiment located on the bottom of the container and can be screwed down in pressure-tight manner. The container 1, which is preferably filled with water, contains two floating bodies 5 and 6, whereof one constitutes an immitation space ship and the other a free balloon.

In the front area of casing base 3, there are two operating levers 7 and 8 for controlling the floating body movements in the container liquid. Rotary knob 7 is specifically used for the fine control or regulation of the liquid pressure in the container and lever 8 is used for the rough and rapid control or regulation of the liquid pressure in the container.

In the manner illustrated in the following drawings, floating bodies 5 and 6 can be moved horizontally and vertically by means of the two operating levers. As floating bodies 5 and 6 have a certain inertia in the vertical movement thereof by a sudden upward or downward movement of lever 8 a rapid pressure change can be brought about in the container liquid, so that the liquid already located in the floating body casing is suddenly expelled through a nozzle opening. As a result, the floating body performs a horizontal movement, without moving significantly or noticeably in the vertical direction.

The vertical movement is essentially brought about by the fine control knob 7. However, the pressurizing device can be designed in such a way that both control levers act on one pressurizing member or the pressure change in container 1 is controlled by one lever only. It may also prove advantageous to make the pressurizing device separate from the casing, connecting it to the container liquid by means of a hose.

As a further development of the toy or plaything, the liquid container 1 contains horizontally or vertically directed obstacles, particularly walls 2*a*, gates, openings 2*b* or passages of a random size and shape, through which the floating bodies can be moved.

In this way, the toy can be varied in a number of different ways and made, e.g., into a game of skill. The walls 2*a*, obstacles, passages 2*b*, platforms, etc. within the liquid container 1 can be designed in a varied manner in such a way that new playing systems can constantly be designed.

In order to be able to direct and control one of the many floating bodies in container 1, preferably in the vicinity of the container bottom, there are detachably fitted magnets 9 and 10 for fixing one or more of the floating bodies or transport loads equipped with a member reacting to the magnetic force.

In the drawing, the imitation free balloon 6 is locally fixed in this way by the inserted magnet 10. As soon as magnet 10 is removed from the casing base, the free balloon 6 having a magnetic or metal plate on the basket can move freely again. In this way, floating bodies with the most varied designs can be located in the liquid container, such as, e.g., imitation flying objects, floating animals, etc., which can be fixed if they are not directed by the pressure control.

Figure 2:
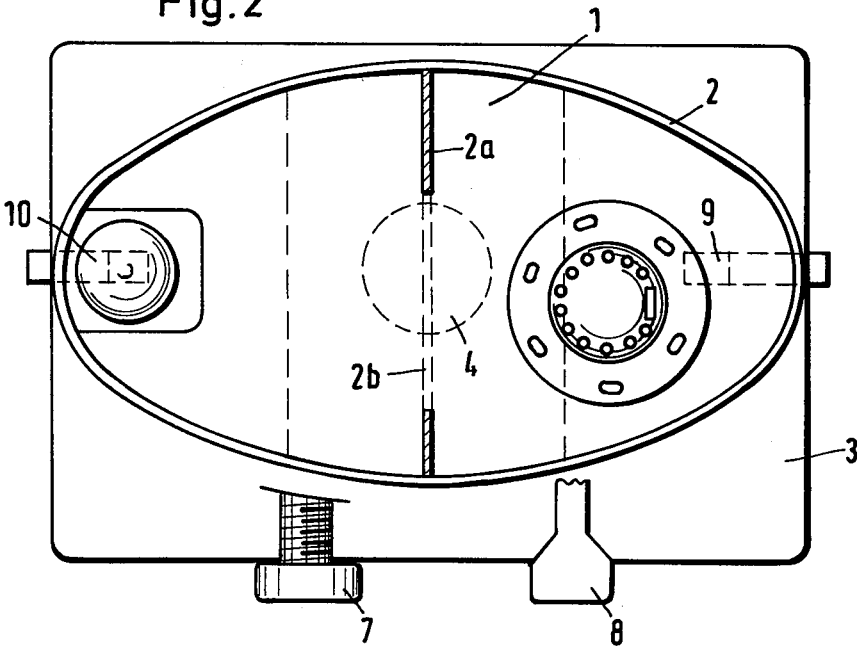
FIG. 2 is the same toy viewed from above.

FIG. 2 shows the same placing as in FIG. 1 in a view from above. The same reference numerals are used, so that the description of FIG. 1 also applies to FIG. 2.

Figure 3:
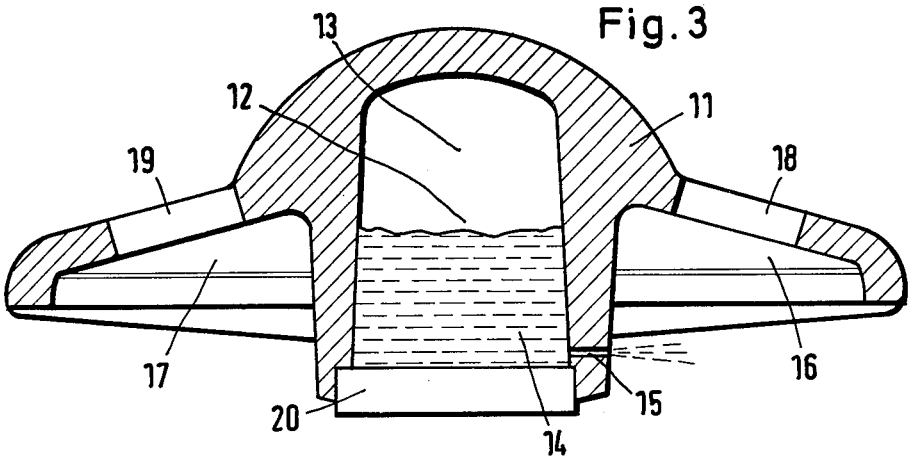
FIG. 3 is a cross-section through the floating body when in the form of a space ship.

FIG. 3 also is a cross-section through the floating body in the form of an imitation space ship. The floating body casing 11 has a cavity 12 whose upper area 13 is filled with air and whose lower area 14 is filled with liquid, e.g. water. Cavity 12 is constructed as a closed cavity and is only connected to the surrounding container liquid by the nozzle opening 15 through which the liquid 14 flows in and out. If the pressure on the container liquid is increased, liquid flows into cavity area 14 and the air-filled cavity area 13 is compressed, so that the volume and consequently the buoyancy are reduced. Thus, the floating body will sink downwards, because the volumetric weight has become greater than the displaced liquid. As soon as the liquid pressure in the container is reduced, the somewhat compressed space 13 expands again and part of the liquid flows from area 14 through the nozzle and out of the floating body again. Due to the reaction or recoil action of the liquid escaping from nozzle 15, the floating body is thereby moved in a horizontal direction. As a result of a rapid pressure increase/pressure decrease sequence (approximately four alternations per second) the floating body is given solely a horizontal movement, because a vertical movement does not occur to any noticeable extent due to the inertia of the actual floating body. On increasing the pressure in the container liquid, the liquid flowing into cavity 12 has virtually no action on the movement of the floating body and in actual fact only the intermittently escaping liquid in the case of a rapid pressure change frequency leads to an acceleration of said body due to the recoil action which occurs. The remaining cavities 16 and 17 of the floating body are provided at the top with vent holes 18, 19, so that no additional air cushion can form in the floating body, particularly as in this construction cavities 16 and 17 are open at the bottom.

On the bottom of this floating body construction there is preferably a magnetic, iron or nickel member 20 making it possible to take up and transport loads formed from iron, nickel or magnetic material. This metal or magnetic member 20 simultaneously serves to seal the bottom of cavity 12.

However, the transporting and taking up of loads can also be carried out by means of gripping devices, load hooks or similar mechanical means preferably provided in the lower part of the floating body.

Figure 4:
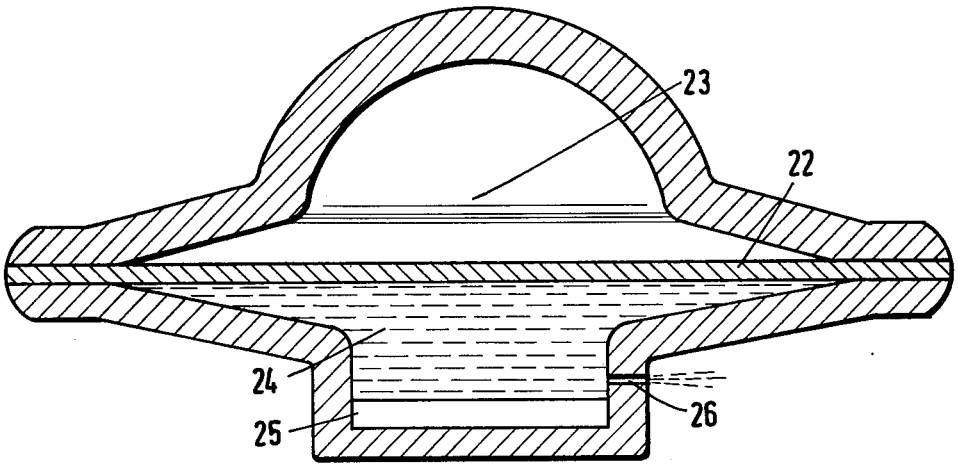
FIG. 4 is a cross-section through the floating body in the form of a space ship.

FIG. 4 also shows a cross-section through a floating body in the form of a space ship with the difference that the inner cavity of said body is subdivided by a diaphragm 22 into a closed air area 23 and a closed liquid area 24. The lower area also contains a magnetic or metal plate 25 which also serves as ballast for obtaining the correct buoyancy values of the floating body.

The operation with this construction is the same as for FIG. 3. As soon as the pressure changes in the container liquid, liquid flows into cavity 24 of the floating body and presses diaphragm 24 upwards, so that the air area 23 is compressed. This reduces the buoyancy and the floating body sinks to the bottom, if it initially had only a slight buoyancy excess. If the pressure in the container liquid is reduced again, the air area 23 expands and the resilient diaphragm 22 presses the liquid out of cavity 24 through nozzle 26 and out of the casing, so that once again a recoil action occurs which moves the floating body forwards in the horizontal direction. The liquid area 24 is filled at the start of the game by briefly producing a vacuum in the container liquid by the pressurizing or vacuum-producing means, so that area 24 is filled with liquid by suction.

Figure 5:
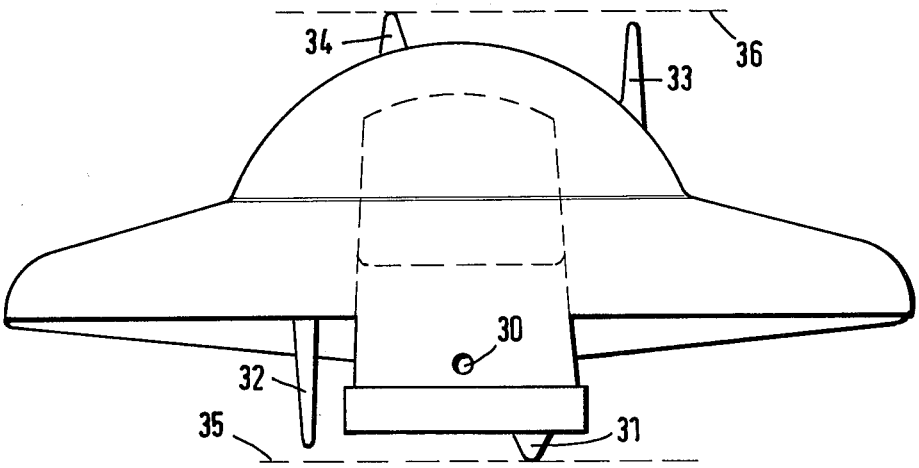
FIG. 5 is a side view of the floating body with a basic representation of the control device.

FIG. 5 shows a side view of the floating body with a basic representation of the control means. The drawing shows the floating body from the rear, so that nozzle opening 30 faces the viewer. In principle, the floating body is controlled in the simplest possible way in that its casing is on one side, i.e. outside the central axis of movement, in contact with the walls of the liquid container, particularly the bottom thereof. For controlling the floating body in this construction, its top and/or bottom have projecting casing parts 31, 32, 33, 34, preferably arranged eccentrically with respect to the nozzle thrust axis. The parts give the floating body a rotary or curved movement in the case of contact between the forwardly moving floating body and the liquid container bottom 35 or other objects, platforms, etc., or on contact with walls 36, surfaces etc., of the liquid container located above said body. In the case of bottom contact, the control effect by the rotary movement is brought about in that the projecting casing parts are positioned eccentrically or laterally with respect to the nozzle thrust axis or the central axis of movement. In order to bring about both curved movements (to the right and to the left) a plurality of casing parts 31, 32 or 33, 34 projecting to a varying extent from the floating body casing and the nozzle thrust axis or centre line of the floating body in such a way that when there is slight contact between the body and a contact member 31 located close to the nozzle thrust axis, there is a rotary movement in one direction (e.g. to the right) and in the case of more powerful contact with two contact members 31, 32 and a slight slope of the floating body it is possible to obtain the other rotation direction (e.g. to the left) by friction of the contact member 32 located further from the nozzle thrust axis.

The contact member 32 which is further from the nozzle thrust axis has the longer lever to said axis and therefore the greater braking action, so that there is a rotation to the left during the forward movement of the floating body.

The same takes place with contact of the top of the container. As soon as the casing part 33 which projects somewhat less is in contact with the container top 36 (or a flat member located at the top) the floating body again acquires a slightly inclined position and as soon as the floating body buoyancy has increased sufficiently and with a simultaneous forward movement, a rotation to the right and consequently a curved movement to the right is started, because the lever action of contact member 33 with respect to the nozzle thrust axis of nozzle 30 is greater than the lever action of contact member 34. In this way, the floating body can be precisely controlled in any random direction on the container bottom or in contact with the top of the container or in contact with horizontally positioned platforms, ramps, obstacles, etc., and then, by breaking off contact, can be moved straight ahead again by means of a buoyancy change.

Figure 6:
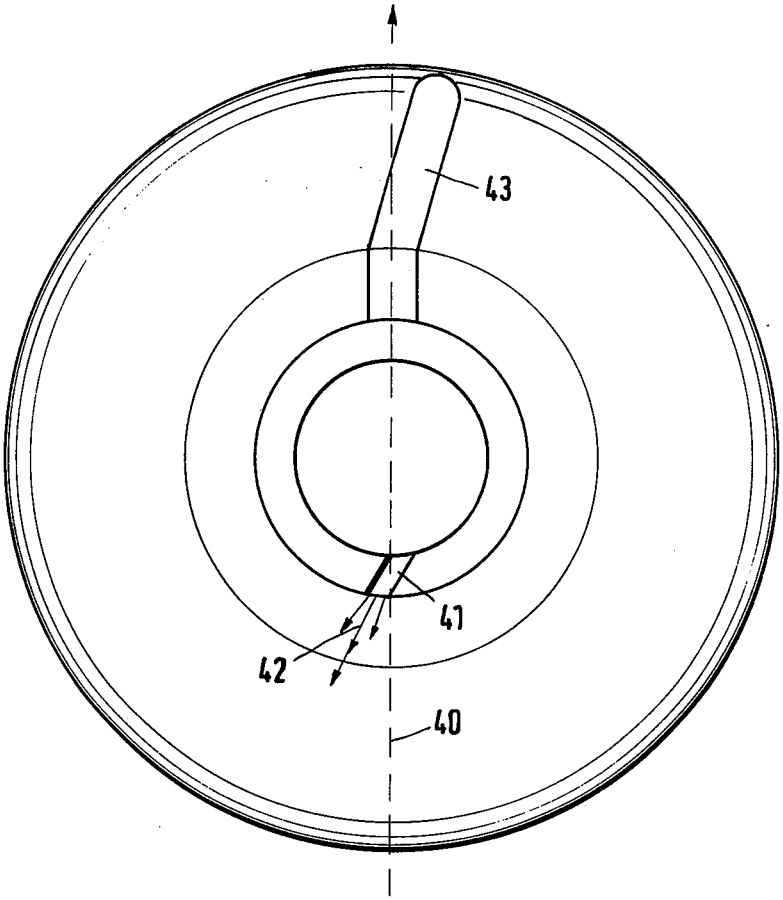
FIG. 6 is a plan view and basic view for the control of a floating body in the form of a space ship.

FIG. 6 is a plan view and basic view for the control of a circular floating body in the form of a space ship. In this construction, the floating body is controlled in that the liquid jet 42 used for accelerating the floating body acts to a greater or lesser extent in the tangential direction or at an angle to the floating body axis and consequently gives said body a rotary or curved movement. This is brought about by arranging the nozzle opening 41 so that it varies from the radial direction 40 with circular floating bodies or varies from the floating body axis 40 in the case of elongated floating bodies.

However, in order to give the floating body the two movement directions, said body is given fixed or movably articulated inclined control surfaces 43, stabilizing surfaces or fins which are bent at an angle to the vertical or horizontal and which impart a curved or rotary movement or a straight-ahead movement to the vertically or horizontally accelerated floating body.

In the case of the construction of FIG. 6, control surface 43 which is inclined to the movement axis 40 of the floating body gives the latter a rotation to the right and soon as the nozzle thrust, which produces a rotation to the left, is stopped, the floating body only moves forward by centrifugalforce. In this way, by a metered use of the recoil force from nozzle 41 it is possible to obtain a movement to the left, straight ahead or to the right.

However, the control surfaces on the floating body can also be fitted in some other random way so that they exert a control in all possible horizontal or vertical movement directions. Thus, rotary movements of the rising or falling floating body can still be achieved if control surfaces are fitted in a propeller-like manner with a given blade angle on the periphery of the round floating body.

Figure 7:
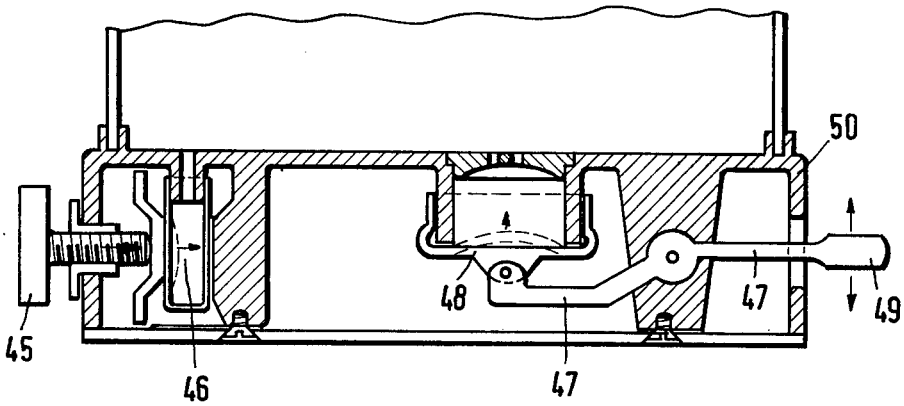
FIG. 7 is a longitudinal section through the casing base, with a pressurizing device.

FIG. 7 is a longitudinal section through the casing base with the pressurizing device. The pressurizing device preferably comprises two units, one of which is used for the fine or precision control of the floating body buoyancy, preferably by means of a threaded screw 45 which presses on the container liquid by means of an elastic diaphragm or an elastic body 46. The other unit comprises a lever mechanism 47 permitting the coarse and rapid control of the floating body through an elastic diaphragm 48 or an elastic body, whose liquid-filled inner space is connected to the container liquid and is pressed in by the lever mechanism 47.

In this way, it is possible to adjust the suspended state of the floating body by means of the fine control screw 45. By means of the rapid control lever key 49, the floating body can be moved backwads and forwards and controlled within the container, as a function of with which sequence and with which intensity the pressure in the container is changed by means of the lever mechanism 47.

The entertainment effect is particularly interesting if the complete control mechanism is housed so as not to be visible in base 50 of the liquid container.

Figure 8:
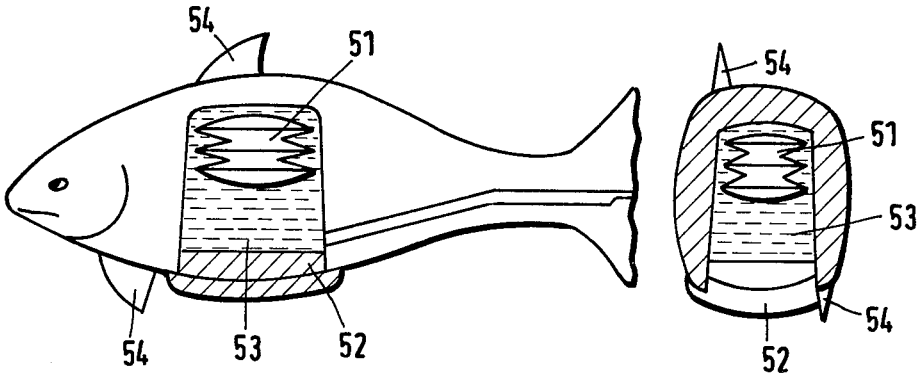
FIG. 8 is a side view and basic view of a floating body in the form of a fish.

FIG. 8 shows a side view and basic diagram of a floating body in the form of a fish. The difference compared with the hitherto described floating bodies is that the air or air bladder is surrounded by a separate sleeve 51 in such a way that the air is located in a closed hollow body, e.g. a bellows or a wholly or partly compressible and/or expandible container, over which partly or wholly flows the liquid which is in particular located in the floating body casing. The advantage of this construction is that the buoyancy value of the floating body can be predetermined.

As a result of the volume of bellows 51, it is possible to approximately adjust from the outset, the suspended state of the floating body, here in the form of a fish. Prior to being immersed in the container liquid, the bottom of the floating body is turned upwards, the end plate 52 removed and cavity 53 filled with liquid. The end plate 52 is then re-fitted and the floating body is ready to operate.

FIG. 8 also shows how the floating body, in the form of a fish, can be controlled by contact by the arrangement of fins 54 in the vicinity of the bottom or on the top of the container, in the manner described with reference to FIG. 5.

Figure 9:
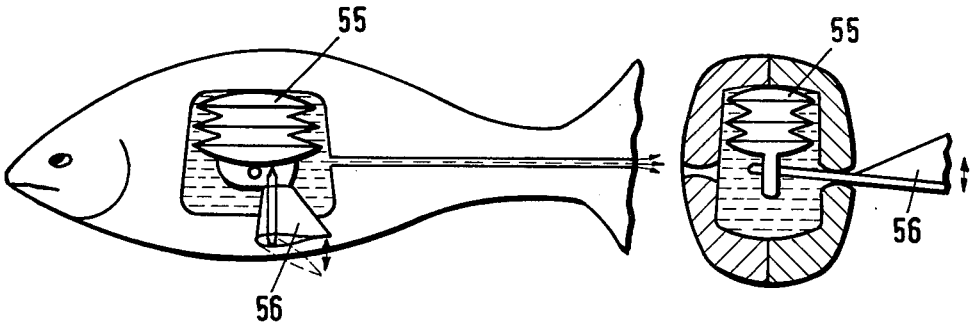
FIG. 9 is a floating body according to FIG. 8, but with mechanically movable parts.

FIG. 9 shows the same floating body construction in the form of a fish, except that the air container 55 in the form of a bellows is used in order to move backwards and forwards mechanical parts, in this case, e.g. movable fins 56, as soon as the pressure in the container liquid is changed.

In general, the principle is that on changing the volume of the compressible or expandable air container 55 it acts on the mechanically movable parts in such a way that the latter perform movements. The nature of the parts to be moved and the mechanisms used can be constructed and arranged in a random manner.

Such closed air containers can also be provided at a random point on the liquid container in order to bring about mechanical movements, particularly movements of the shaped parts, on changing the container liquid pressure, thereby further increasing the entertainment value.

Figure 10:
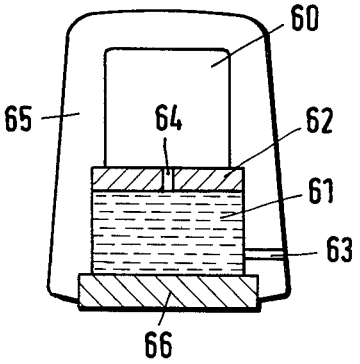
FIG. 10 is a longitudinal section through a casing unit for filling with air and liquid and which can be inserted in the floating body.

FIG. 10 is a longitudinal section of a casing unit for the air and liquid filling insertable in the floating body. It is a cavity casing unit which, for manufacturing reasons, can be inserted or removed with respect to a floating body having a random external configuration, being locked in friction-tight or form-tight manner.

Cavity 60 which receives the air filling for bouyancy purposes is separate in this construction from cavity 61 in the floating body casing which receives the liquid for the nozzle jet function. The partitioning is brought about by a wall 62 having a small bore or opening 64, with a diameter preferably less than 1 mm. In this way, it is possible before starting the game to fill cavity 61 with liquid, after removing end plate 66 without it being able to penetrate the cavity 60 intended for the air filling as a result of the very small opening 64. The end plate 66 is then re-fitted and the floating body insert or the floating body is ready to operate. The partition in this construction is preferably fixed in friction-tight manner in casing 65. For manufacturing reasons, it is advantageous for the removable casing unit 65 to be provided with a nozzle opening 63 for the horizontal displacement of the floating body.

The advantages obtainable by means of the invention are in particular that by varying the pressure in the container liquid a floating body which floats freely in a closed liquid container and which has a random shape and design can be moved not only vertically, but also horizontally by means of a simple operating mechanism. The invention also makes it possible to impart rotary and curved accelerations to the floating body, so that it is possible to produce the most varied playthings with three-dimensionally guidable floating figures or bodies with a high entertainment value. As a result of the different possibilities of realising the invention, it is possible to vary the degree of skill required for playing the game and also obtain a continuous supply of new playing systems. The invention has a wide range of possible applications due to the possibility of providing the liquid container with accessories, such as the countryside, an airfield, aquarium, space, labyrinth or football pitch, etc., whilst adapting to the particular shape and configuration given to the floating body.

What is claimed is:

1. A toy comprising:

(a) a partly transparent liquid container;

(b) means for varying the pressure of the liquid in the container; and (c) a freely-floating body provided in the container and movable by buoyancy changes, the body including (i) a casing with a closed cavity therein forming a liquid-filled zone and an air zone, wherein the air zone is compressible within the cavity by the increased liquid pressure in the container varied by the pressure varying means, (ii) a single nozzle opening formed in the casing for providing the only inlet and outlet of liquid flow between the container and body cavity, the nozzle opening for producing a directed jet-like outflow of liquid from the body casing, forming a thrust directional axis for the body and imparting an accelerated horizontal movement of the floating body within the container only during rapid pressure changes in the body cavity as the air zone expands therein, and (iii) container contact means fixedly connected to and projecting at predetermined locations from the outside of the body casing for controlling and imparting rotational movement of the floating body, said container contact means including a plurality of casing parts projecting to a varying distance from the floating body casing and arranged eccentrically with respect to the nozzle thrust directional axis on at least one of the top and bottom of the floating body for controlling the body and imparting a rotary or curved movement when contacting one of the liquid container and other objects within the container with one of the top and bottom of the floating body, said predetermined locations being arranged such that a rotary movement in one direction is imparted when slight contact is made between one of said casing parts located close to the nozzle thrust axis and at least one of the container and objects within the container, and said rotary movement in the other direction is imparted when a pronounced contact is made by two of said casing parts and at least one of the container and objects within the container while the floating body is sloped slightly in the opposite direction.

2. A toy according to claim 1, wherein the body further includes a separate bellows-like container for forming a closed self-contained air zone and around which wholly or partly flows the liquid in the cavity.

3. A toy according to claim 1, wherein the body further includes a wall within the body cavity for forming separate air and liquid zones, the wall having a small opening for communication between the air and liquid zones.

4. A toy according to claim 1, wherein the cavity for forming the air and liquid zones within the floating body is in the form of a casing unit which can be placed in or removed from the floating body and which has the nozzle opening formed therein.

* * * * *